US005813586A

United States Patent [19]

Van den Steen et al.

[11] Patent Number: 5,813,586

[45] Date of Patent: Sep. 29, 1998

[54] APPARATUS AND METHOD FOR CONTROLLING WEB SPEED

[75] Inventors: Freddy Van den Steen, Serskamp; Eric M. De Smedt, Opwijk; Wim Verbeke, Aalst, all of Belgium

[73] Assignee: FMC Corporation, Chicago, Ill.

[21] Appl. No.: 901,823

[22] Filed: Jul. 28, 1997

Related U.S. Application Data

[63] Continuation of Ser. No. 560,425, Nov. 17, 1995, abandoned.

[51] Int. Cl.[6] ..... B65H 20/00; B23Q 15/00

[52] U.S. Cl. ..... 226/8; 226/44; 226/45

[58] Field of Search ..... 226/8, 44, 45, 226/119

[56] References Cited

U.S. PATENT DOCUMENTS

| | | | |
|---|---|---|---|
| 4,702,731 | 10/1987 | Lambrecht et al. | 493/196 |
| 4,798,576 | 1/1989 | DeBin | 493/196 |

FOREIGN PATENT DOCUMENTS

| | | | |
|---|---|---|---|
| 3241362 | 11/1984 | Germany | 226/44 |
| 0137754 | 7/1985 | Japan | 226/44 |
| 5338883 | 12/1993 | Japan | 226/44 |
| 6135607 | 5/1994 | Japan | 226/44 |
| 6135609 | 5/1994 | Japan | 226/44 |

*Primary Examiner*—Rodney H. Bonck
*Assistant Examiner*—Matthew A. Kaness
*Attorney, Agent, or Firm*—Rockey, Milnamow & Katz, Ltd.

[57] ABSTRACT

There is provided an apparatus for controlling the infeed speed of a bag making machine. In one embodiment, the nip roll speed is changed from a variable speed to a fixed speed after a cycle interrupt occurs. Once a dancer arm returns to an upward position, the nip roll speed changes back to the variable speed. In another embodiment, the nip roll speed is approximately equal to an average line speed and the dancer is trimmed to correct the speed of the nip rolls. There is also disclosed a method for controlling the infeed speed.

18 Claims, 5 Drawing Sheets

APPARATUS AND METHOD FOR CONTROLLING WEB SPEED

This application is a continuation of application Ser. No. 08/560,425, filed Nov. 17, 1995, now abandoned.

BACKGROUND OF THE INVENTION

1. Field of the Invention

This invention relates to plastic bag fabricating machines and more particularly to an apparatus and method for controlling the flow of film.

2. Description of Related Art

An intermittently working bag machine stops production after a predetermined number of bags has been produced to allow a stacking conveyor to be indexed. After the indexing has occurred, production can be resumed. This process interruption is generally known in the industry as cycle interrupt. As a result, the next predetermined number of bags can be produced and stacked on an adjacent stacking device after the cycle interrupt has been completed.

A bag machine may employ a driven nip roll system to pull film from an unwind stand. The speed of these nip rolls is controlled by a dancer. The dancer is capable of not only storing a certain amount of film, it may also provide tension for the film.

Referring to FIG. 1, there is shown a prior art system for controlling the infeed of the film or web 10 to a bag making machine 12. The web 10 may be fed through a plurality of rolls 14 and through a pair of nip rolls 16. The web 10 may then be fed through rolls 17 on a dancer 18 having a dancer arm 19 and then through a plurality of rolls 20 prior to entering the remainder of the bag making machine 12. An eccentric cam 22 may be disposed by the pivot point 21 of the dancer arm 19 and an analog proximity switch 24 may be disposed near the cam 22. Instead of using proximity switches and cams or eccenters, potentiometers, either rotary or linear, may also be used to measure the position of the dancer 18. The cam 22 may provide speed command voltage to a drive for the nip rolls 16. When, for example, the dancer 18 goes upward, the cam 22 may provide speed command voltage such that the drive for nip rolls 16 increases the speed of the nip rolls. When, for example, the dancer 18 goes downward, the cam 22 may provide speed command voltage such that the drive for the nip rolls 16 decreases the speed of the nip rolls. That is, the cam 22 may provide an appropriate signal for providing a variable speed for the nip rolls.

As the bag machine 12 stops production for a short time during the cycle interrupt, the dancer 18 will start to move downward and the nip rolls 16 will gradually slow down as the speed of these nip rolls is controlled by the position of the dancer 18 via the cam 22 and the analog proximity switch 24. The dancer 18 further stores a certain amount of film 10 due to the slowdown in the nip rolls 16. At the end of the cycle interrupt, the dancer 18 will start to rise because of the demand from the draw rolls 23 disposed within the bag machine 12. Therefore, the speed of the nip rolls 16 will gradually increase to the nominal operating speed.

However, typical prior art systems result in a large fluctuation of the speed of the nip rolls 16 between the nominal operating speed and the cycle interrupt speed. Such a large fluctuation in speed may adversely influence upstream processes. For example, hot air longitudinal sealing or ball and die punching may be adversely affected where a larger fluctuation in speed occurs in the nip rolls 16. As a result, the bags being produced may be of an inconsistent quality. Therefore, it is desired to have a bag machine having an infeed system where the fluctuation in the speed of the nip rolls 16 is reduced.

SUMMARY OF THE INVENTION

There is provided an apparatus for controlling the speed of a web comprising nip rolls for feeding the web, a dancer having a dancer arm for receiving the web, the dancer arm having an upward and downward position, a sensor for sensing a position of the dancer arm, draw rolls disposed downstream from the nip rolls, means for providing the nip rolls with a fixed speed once a cycle interrupt occurs, and means for providing the nip rolls with a variable speed once the sensor senses that the dancer arm reaches the upward position.

There is also provided an apparatus for controlling the speed of a web comprising nip rolls for feeding the web, a dancer having a dancer arm for receiving the web, the dancer arm having an upward and downward position, a sensor for sensing a position of the dancer arm, draw rolls disposed downstream from the nip rolls, a controller for comparing an actual position of the dancer arm for a given point in time in a production run with a preprogrammed position corresponding to the given point in time, and means for correcting a speed in the nip rolls such that the dancer arm approximately equals a subsequent preprogrammed position for a subsequent point in time.

There is further provided a method of controlling the speed of a web comprising providing nip rolls with a fixed speed once a cycle interrupt occurs, sensing a position of a dancer arm, the dancer arm having an upward and downward position, and providing the nip rolls with a variable speed once the dancer arm reaches the upward position.

There is also provided a method of controlling the speed of a web comprising comparing an actual position of a dancer arm for a given point in time in a production run with a preprogrammed position corresponding to the given point in time and correcting a speed of nip rolls such that the dancer arm approximately equals a subsequent preprogrammed position for a subsequent point in time.

DESCRIPTION OF THE PREFERRED EMBODIMENTS

Figure 2:
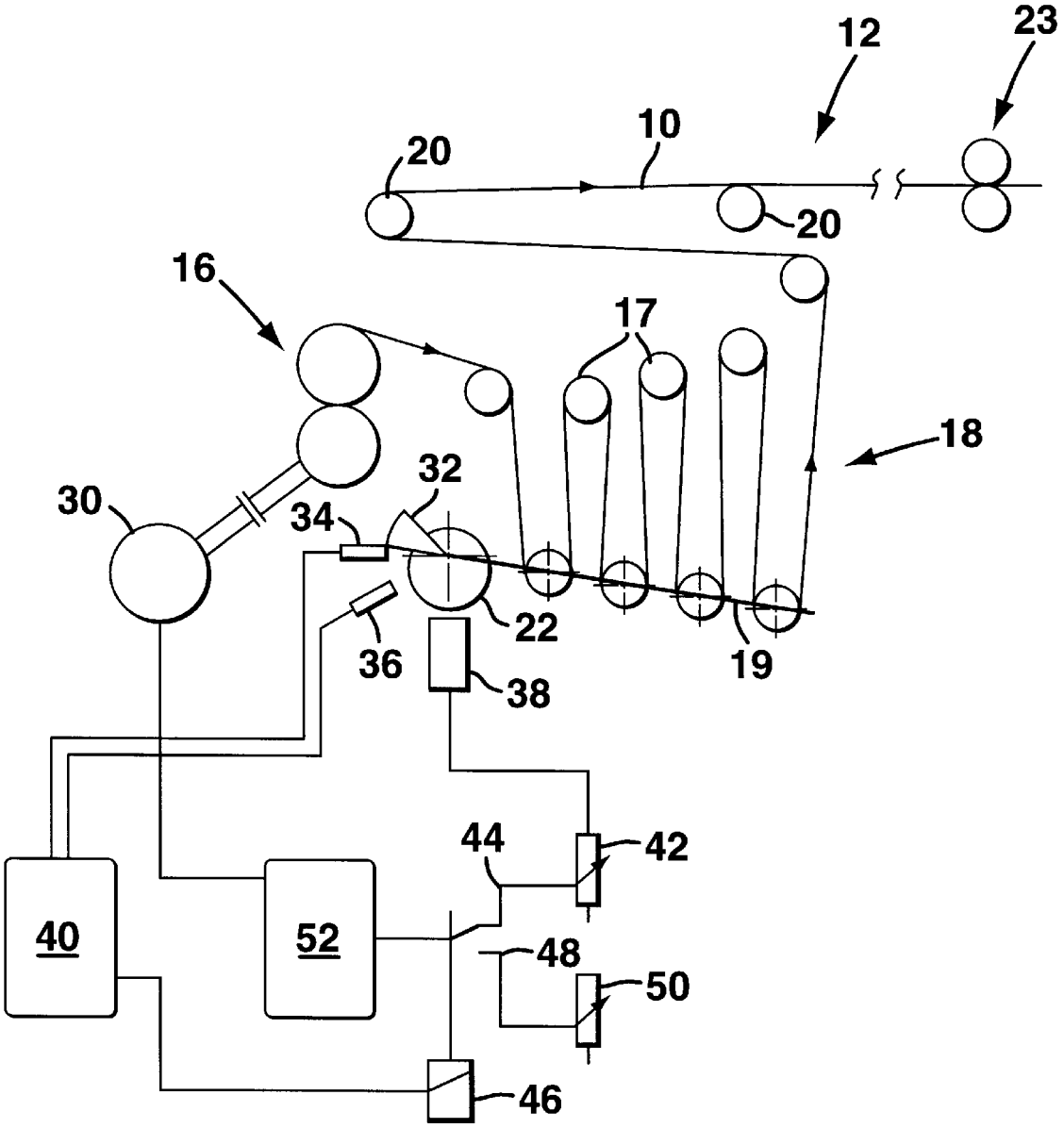
FIG. 2 is a schematic view of an infeed system to a bag making machine in accordance with a first preferred embodiment of the present invention.

Referring to FIG. 2, there is provided is a schematic view of an infeed system to a bag making machine 12 in accordance with a first preferred embodiment of the present invention. Similar components have been labeled similarly for purposes of clarity.

A motor 30 is operatively connected to nip rolls 16 as is standardly used in the bag making industry. Further, a flag 32, such as a sheet of metal or a magnet as is standardly used in the industry, is disposed at one end of the dancer arm 19. The flag 32 may be used to activate sensors or proximity switches 34, 36, and 38. Proximity switches 34 and 36 may be connected to a controller 40 and are preferably on/off proximity switches. The controller 40 is preferably a programmable logic controller. Alternatively, the controller 40 may be a servo controller, a personal computer or an industrial computer. As will be described, proximity switch 34 informs the controller 40 to switch back from a fixed speed to a normal operating speed and proximity switch 36 is used as a safety control.

Figure 1:
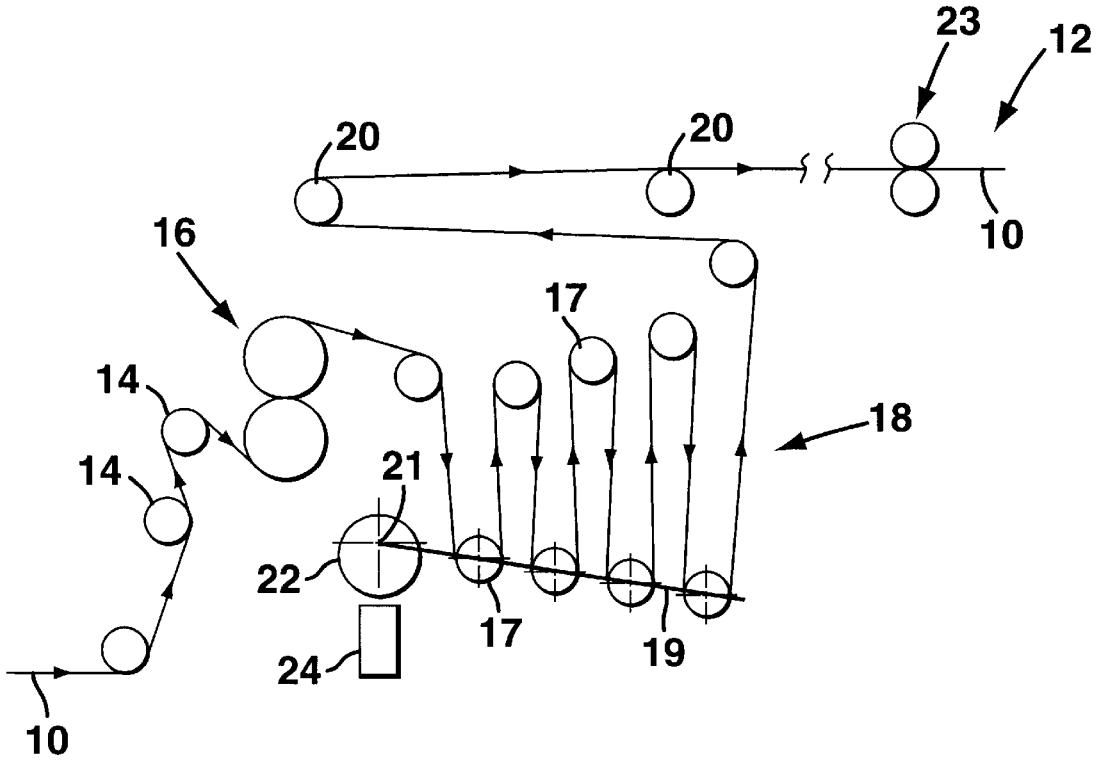
FIG 1 (PRIOR ART)
FIG. 1 is a schematic view of a prior art infeed system to a bag making machine.

Proximity switch 38 which is preferably an analog proximity switch is similar in function to proximity switch 24 shown in FIG. 1 and may be connected to a first potentiometer 42. Potentiometer 42 may be, for example, a ten turn potentiometer. The output of potentiometer 42 is connected to node 44 of a relay 46. The second node 48 of relay 46 is connected to a second potentiometer 50. The relay 46 is further connected to controller 40. A frequency controller 52, such as a frequency controller manufactured by Allen-Bradley Company, Inc. of Milwaukee, Wis., connects either nodes 44 or 48 of the relay 46 to the motor 30. The setting of potentiometer 42 provides a variable speed or normal production speed for the nip rolls 16 during normal operation (i.e., when the bag machine 12 is not in the cycle interrupt phase) via relay 46, frequency controller 52 and motor 30. Similarly, the setting of potentiometer 50 provides a fixed speed or cycle interrupt speed for the nip rolls 16 when the cycle interrupt operation of the bag machine 12 occurs.

Figure 3:
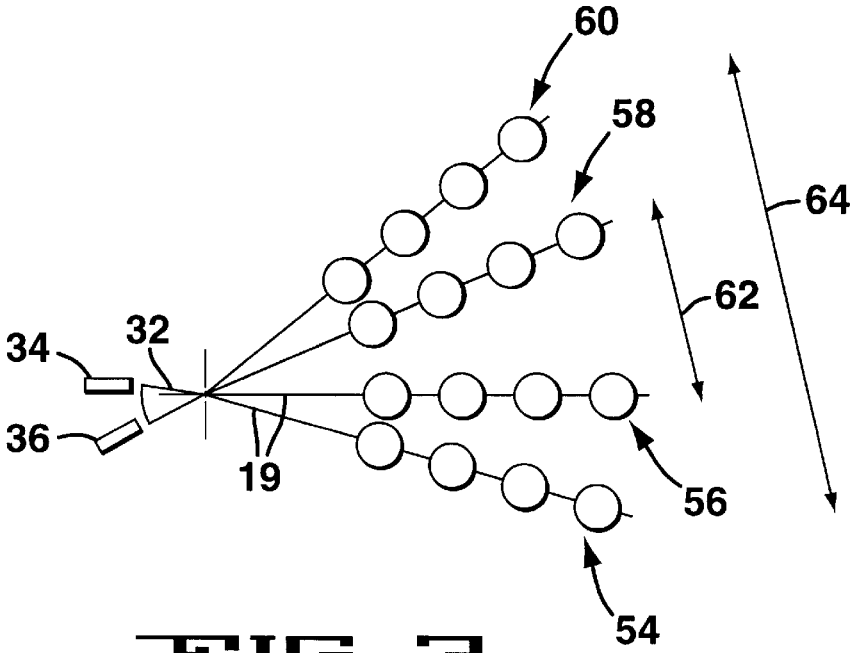
FIG. 3 is a schematic view of the variation in the position of the dancer arm.

Referring also to FIG. 3, there is shown a schematic view of the variation of the position of the dancer arm 19. Position 54 is the maximum downward position of the dancer arm 19 and occurs when the nip rolls 16 are at zero speed or when the bag machine 12 has stopped. Position 60 is the maximum upward position of the dancer arm. This position occurs when the speed of this nip rolls 16 are so high that the bag machine 12 may turn off to prevent damage to the equipment. Arrow 64 indicates the maximum mechanical displacement of the dancer arm 19 and arrow 62 indicates the normal dancer displacement during interrupt.

The dancer arm 19 is at a downward position 56 at the end of the cycle interrupt. Position 56 may be greater than the maximum downward position 54 and less than fifty percent of the maximum mechanical displacement 64 as measured from the maximum downward position 54. Preferably, position 56 is between ten to twenty percent of the maximum mechanical displacement 64 as measured from the maximum downward position 54. However, as will be discussed, a safety device may be installed to prevent the dancer arm 19 from bottoming out. As a result, position 56 is preferably at such a level as to allow proximity switch 36 to sense the falling of the dancer arm 19 and stop the nip rolls 16 prior to the dancer arm 19 reaching position 54.

The dancer arm 19 is at an upward position 58 when the bag machine 12 is operating at normal production speed prior to the end of a given production run. Position 58 may be greater than fifty percent of the maximum mechanical displacement 64 as measured from the maximum downward position 54 and less than the maximum upward position 60. Preferably, position 56 is between eighty to ninety percent of the maximum mechanical displacement as measured from the maximum downward position 54.

Figure 4:
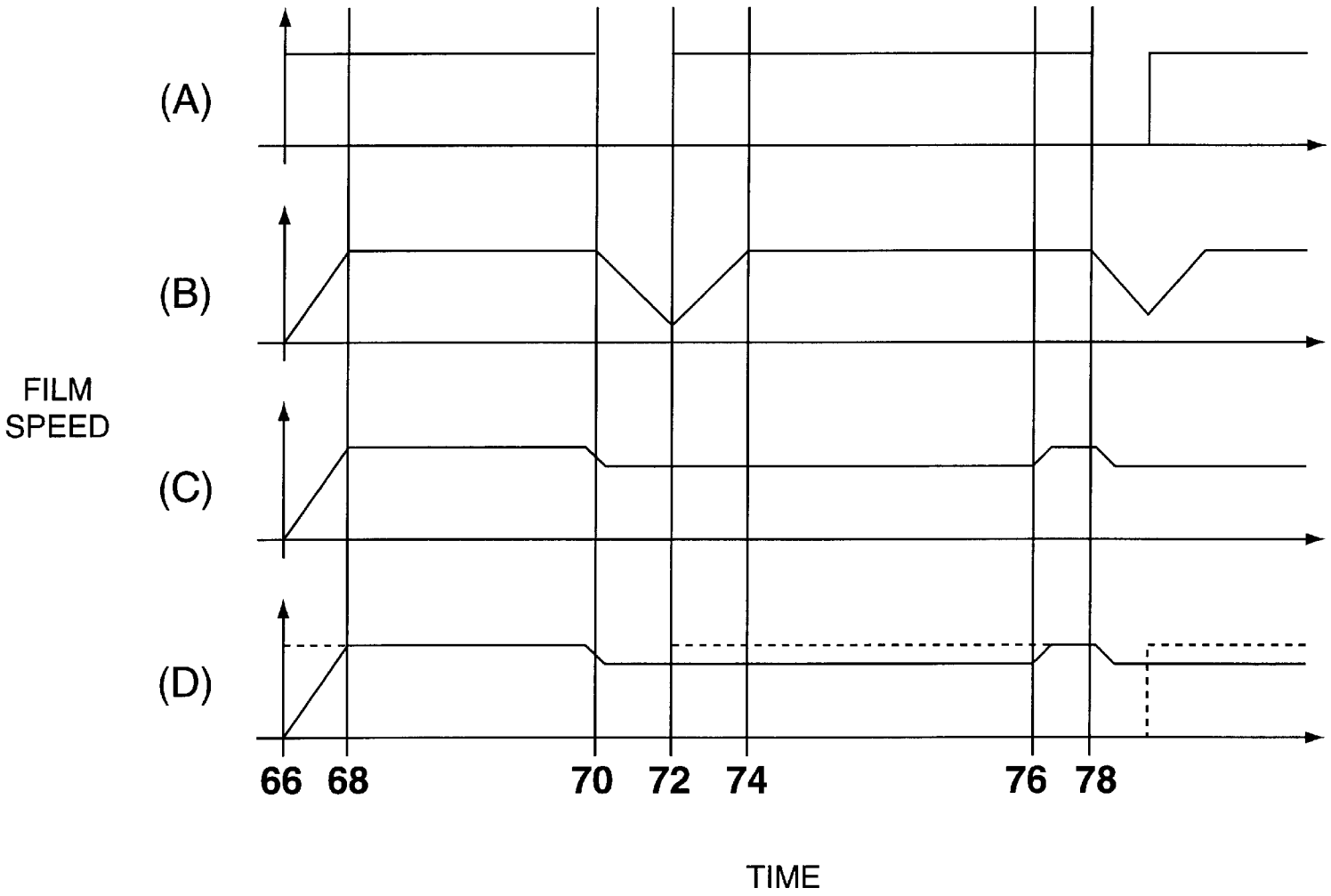
FIG. 4A is a plot of the actual average speed as pulled by draw rolls during two production runs and during two interrupt cycles.
FIG. 4B shows the infeed speed of the nip rolls of a typical prior art system.
FIG. 4C shows the infeed speed of the nip rolls of the present invention.
FIG. 4D shows a comparison between the infeed speed of the nip rolls of the present invention and the draw rolls.

Referring also to FIG. 4, there is shown a plot of film speed versus time from start through two production runs. Point 66 on the time line indicates the start of the bag machine 12. Point 68 on the time line indicates that the nip rolls 16 reach the maximum speed and that the dancer 18 is at its maximum working position. Points 70 and 72 on the time line indicate the start and end of a first interrupt cycle, respectively. Point 74 on the time line indicates where the nip rolls reach the maximum speed and the dancer is working at its maximum working position for a prior art system. Point 76 on the time line indicates where the dancer 18 reaches its maximum position in the present invention. Point 78 on the time line indicates the start of the second interrupt cycle.

As shown in FIG. 4A, the actual average speed of the draw rolls 23 is approximately a constant from the start of the bag machine 12 until the cycle interrupt. During the cycle interrupt, the speed of the draw rolls 23 may be zero. As shown in FIG. 4B, the speed of typical prior art nip rolls 16 is shown. The speed of the prior art nip rolls gradually increases from zero to the normal production speed, as shown by points 66 and 68 on the time line. Once the cycle interrupt occurs, the speed of the nip rolls 16 greatly decreases, as shown by points 70 and 72 on the time line. Further, the speed of the nip rolls 16 may greatly have to increase to the normal production speed as shown by point 74 on the time line.

This contrasts to the current invention where the speed of the nip rolls during the cycle interrupt may not vary greatly from the speed of the nip rolls during normal production. As shown in FIGS. 4C and 4D, during the cycle interrupt (i.e., between points 70 and 72) the speed of the fluctuation of the speed of the nip rolls is reduced in comparison with the typical prior art device.

FIG. 4D provides a comparison the speed of the nip rolls 16 and the draw rolls 23, the draw roll speed being shown in dotted lines in that figure.

Specifically, by the use of the flag 32, proximity switch 34, controller 40, and relay 46, the control of the speed of the nip rolls 16 will switch from a variable or normal production speed to the fixed speed at the moment the bag machine 12 begins the cycle interrupt and returns to the normal production speed once the dancer arm 19 returns to position 58. The speed of the nip rolls 16 at the cycle interrupt may, for example, be between fifty to one hundred percent the speed of the nip rolls 16 during normal production. Preferably, the speed of the nip rolls 16 is at or as close to the average line speed as possible during both normal production as well as during the cycle interrupt, as will be discussed. Where the speed of the nip rolls 16 is at the average line speed, the plot may essentially be flat in FIGS. 4C and 4D after point 68 in the time line is reached.

As the bag machine 12 is started, the draw rolls 23 begin pulling the film 10 at a speed equal to the cycle speed multiplied by the draw length, as is standardly done in the industry. This is illustrated at point 66 in the time line of FIG. 4A. Further, the infeed speed of the nip rolls 16 increases from zero to the desired production speed, indicated by points 66 and 68 of FIGS. 4C. The operator sets potentiometer 42 such to bring the dancer to position 58 as shown in FIG. 3 or higher which occurs at point 68 on the time line of FIG. 4C.

At point 70, the controller 40 begins the cycle interrupt, sending a signal to relay 46 and thus energizing relay 46. As a result, the relay 46 changes the speed of the nip rolls 16 to a fixed speed, set by potentiometer 50 via the frequency controller 52. That is, the input of the frequency controller 52 is connected to node 48 of relay 46 rather than to node 44 of relay 46, connecting potentiometer 50 rather than potentiometer 42 to the frequency controller 52 during the cycle interrupt. At point 74, the interrupt ends but as the nip rolls 16 are at a slightly lower speed in comparison to the draw rolls 23 at that point in time, the dancer arm 19 will start to rise until it reaches position 58 as shown in FIG. 3. Preferably, the dancer arm 19 will start to rise and reach position 58 at any time before the next cycle interrupt is reached.

When the dancer arm 19 reaches position 58, the sensor or proximity switch 34 informs the controller 40 to de-energize relay 46, thus connecting potentiometer 42 to the frequency controller 52 rather than potentiometer 50. Specifically, proximity switch 34 informs the controller 40 to switch back, for example, to a conventional cam controlled or eccentric controlled speed. This occurs at point 76 on the time line of FIG. 4. As a result, the motor 30 will drive the nip rolls 16 at the normal operating speed.

Correct setting of the potentiometer 50 can be visually controlled by observing the dancer 18 displacement. At the beginning of a cycle interrupt, the dancer arm 19 should be in position 58. At the end of the cycle interrupt, the dancer arm 19 should be in position 56. After the cycle interrupt is completed, the dancer arm 19 should begin to rise to position 58. If the dancer arm 19 does not lift, then the fixed speed provided by the potentiometer 50 may be set too high. As a result, the fixed speed should be reduced in order to lower the speed of the nip rolls 16 during the cycle interrupt. The speed of the nip rolls 16 should also increase to the production speed prior to the next cycle interrupt as shown by points 76 and 78.

Although the speed of the nip rolls 16 in FIG. 4A is shown to slightly vary after reaching point 68 on the time line, the speed of the nip rolls 16 may be a constant value. Specifically, the speed of the nip rolls 16 may be set, for example, to the average line speed. The average line speed may be calculated by the following equation:

$$\text{Average line speed}=(S\times L\times K)/(K+I),$$

where S is the cycle speed, L is the bag length, K is the number of bags for a given stack, and I is the interrupt count. For example, where the cycle speed is three hundred cycles, the bag length is one foot, there are one hundred bags per stack, and the interrupt count is five bags, the average line speed is 285.7 feet per minute.

The nip rolls 16 may be set to the average line speed via potentiometer 50 where the production run is long enough in relation to the interrupt cycle time to allow the dancer arm 19 to return from position 56 to position 58 prior to the next interrupt cycle. If the production run is not long enough in relation to the interrupt cycle time to allow the dancer arm 19 to return from position 56 to position 58 prior to the next interrupt cycle, then the speed of the nip rolls 16 should be lowered slightly below the average line speed until the dancer arm 19 returns from position 56 to position 58 prior to the next interrupt cycle. That is, the lower the speed the nip rolls 16 are set in relation to the average line speed, the earlier the dancer arm 19 returns from position 56 to position 58 prior to the next interrupt cycle, as shown in FIG. 4D. Preferably, the range designated by arrow 62 in FIG. 3 is as large as possible to allow the dancer 18 to gather the excess web 10 during the cycle interrupt when the nip rolls are operating at a speed higher than the draw rolls 23. This may allow for operating the nip rolls 16 at or near the average line speed.

Where the differences between the fixed speed and the cam controlled speed are smaller, the bag machine 12 may be better tuned. As a result, if the dancer allows enough take up of the web 10 during the cycle interrupt, the speed of the nip rolls may be maintained at a constant speed during normal operation as well as during the cycle interrupt.

Auxiliary equipment, such as longitudinal sealers or ball and die punches can be tuned to the lower constant speed of the nip rolls which occurs after the cycle interrupt takes place. This auxiliary equipment should be set to the lower fixed speed and back to the normal cam controlled speed at the same time relay 46 is energized and de-energized for altering the speed of the nip rolls 16.

Proximity switch 36 may also be provided as a safety device. If during cycle interrupt the dancer arm drops below position 56, the speed control is switched from the preset or fixed value provided by potentiometer 50 to the cam or eccentric controlled value provided by potentiometer 42, eventually bringing the motor 30 to a normal stop. This safety device may be activated, where, for example, the fixed speed set by potentiometer 50 is initially set too high. The safety circuitry may help prevent the dancer arm 19 from bottoming out.

Figure 5:
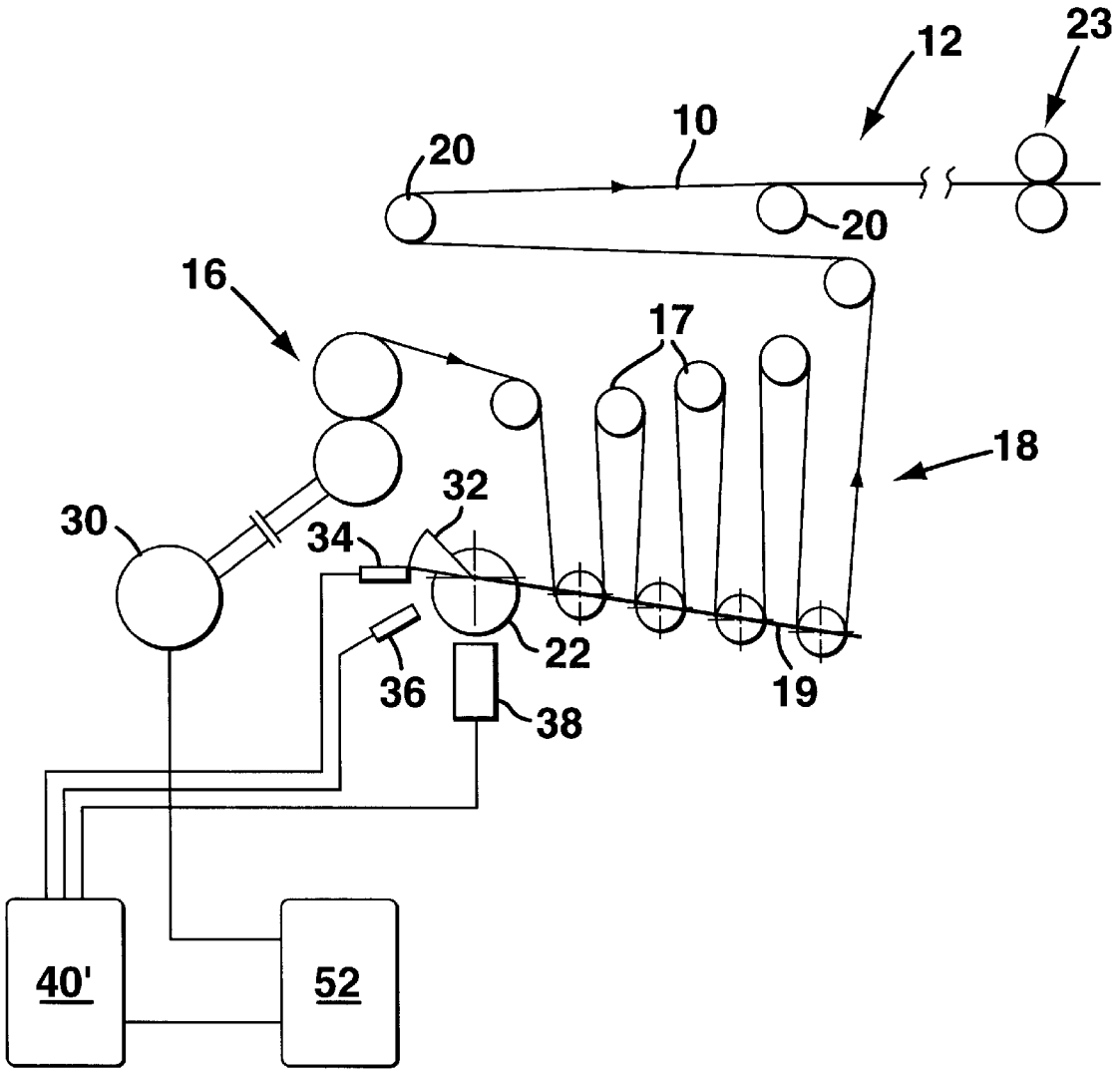
FIG. 5 is a schematic view of an infeed system to a bag making machine in accordance with a second preferred embodiment of the present invention.

Referring now to FIG. 5, there is shown an alternate embodiment for the present invention. Instead of using mechanical devices such as potentiometers 42 and 50 as well as relay 46, the circuitry for controlling the speed of the nip rolls is encompassed by a controller 40'. The controller 40' may be, for example, a programmable logic controller manufactured by Allen-Bradley Company. As with the first preferred embodiment, the outputs of proximity switch 34 and 36 are provided to the controller 40'. On the contrary, the output of proximity switch is provided to the controller 40' as well. In addition, the controller 40' directly provides the activating signal for the frequency controller 52.

The setting during normal operation which would otherwise be set by potentiometer 42 may, for example, be directly inputted into the controller via a control panel, not shown. Further, the setting for the nip rolls 16 during the cycle interrupt (as well as until the dancer arm 19 returns to position 58 as shown in FIG. 3) is also directly inputted into the controller 40'. This is similar in function to the setting provided by potentiometer 50 in the first preferred embodiment (i.e., the potentiometer 50 provides the fixed speed to the nip rolls 16 at the start of the interrupt cycle).

The user of the bag machine 12 may input the bag length, cycle speed, the bags for a given stack, and the number of cycle interrupts for a given operation, as well as the time for a given interrupt into the controller 40'. As a result, the controller 40' may calculate the actual speed as well as the average line speed. The actual speed is the average actual speed of the draw rolls 23 without reference to the interrupt cycle and the average line speed is the average speed of the draw rolls 23 which includes the interrupt cycle. The average line speed may be calculated by the above-noted equation:

$$\text{Average line speed}=(S\times L\times K)/(K+I),$$

where S is the cycle speed, L is the bag length, K is the number of bags for a given stack, and I is the interrupt count.

The controller 40' may directly input a proper signal to the frequency controller 52 for activating the nip rolls 16 at the average line speed. As with the first preferred embodiment, the nip rolls 16 may be activated at the average line speed where the dancer arm 19 is capable of returning from position 56 to position 58 prior to the next interrupt cycle. Otherwise, the controller 40' may be inputted with a setting such that the nip rolls 16 are provided with a fixed speed lower than the average line speed such that the dancer arm 19 returns from position 56 to position 58 prior to the next interrupt cycle. Once the proximity switch 34 senses the return of the dancer arm to position 58, the cam 22 and the proximity switch 38 may be used to provide speed command voltage to drive the nip rolls 16 via the controller 40, frequency controller 52, and motor 30.

Figure 6:
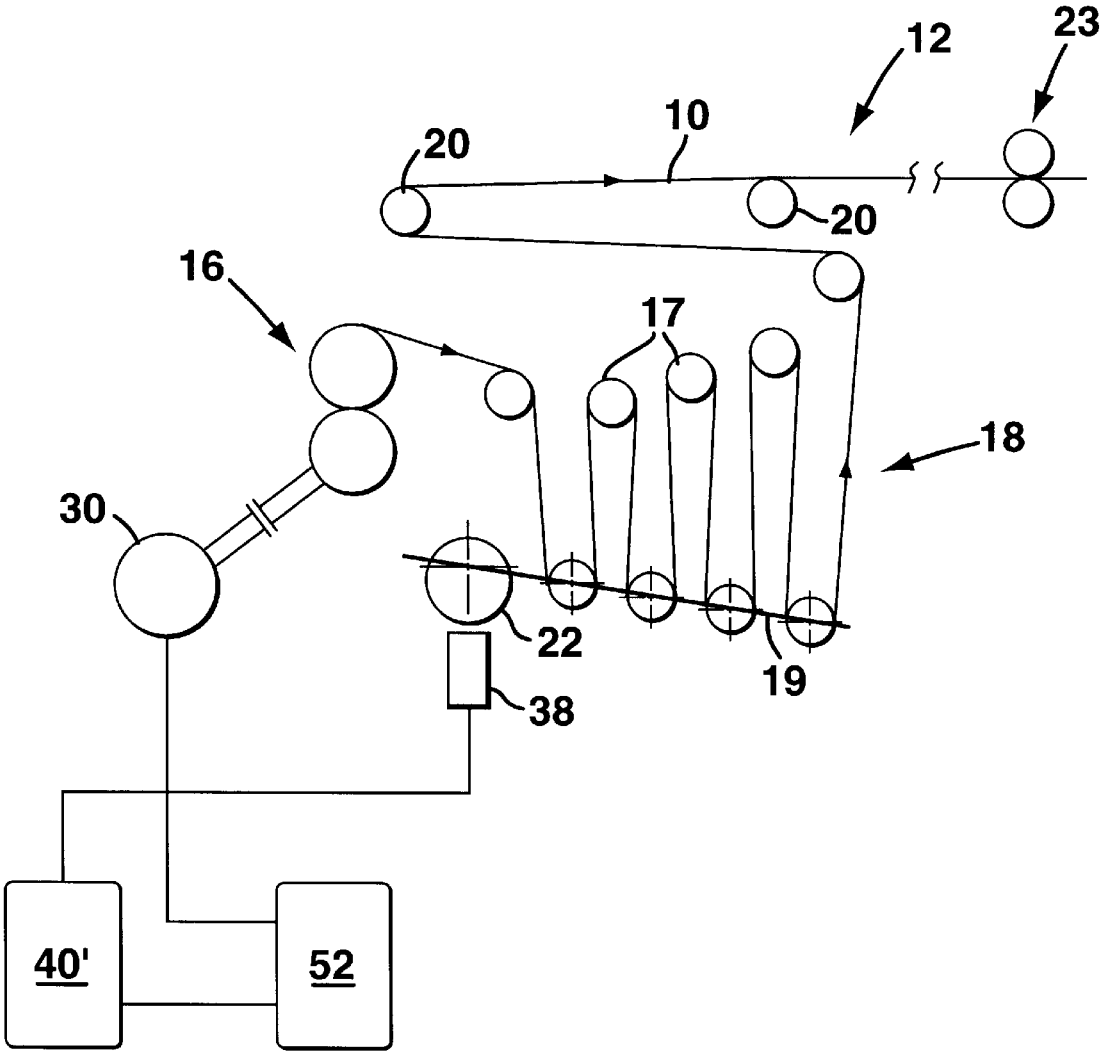
FIG. 6 is a schematic view of an infeed system to a bag making machine in accordance with a third preferred embodiment of the present invention.

Referring now to FIG. 6, there is shown a third preferred embodiment for controlling the speed of the nip rolls 16. In this embodiment, the average line speed can be calculated by the controller 40' and the dancer 18 may be used to trim or correct the speed of the nip rolls 16 to obtain the desired speed during both the production run and cycle interrupt. This embodiment is similar in construction to what is illustrated in FIG. 5 except the proximity switches 34 and 36 and flag 32 are not employed and the position of the dancer arm 19 is used as a small trim. Further, this embodiment utilizes the average line speed as a general guideline for operating the nip rolls 16 and utilizes the controller 40' to alter the speed of the nip rolls 16 should the position of the dancer arm 19 not be at a desired location at a given point on the time line.

Specifically, in this embodiment, at the beginning of a production run (i.e., at or slightly after point 72 of FIG. 4), the dancer arm 19 should be at or near its lower position 56. Further, the dancer arm 19 should be at or near its upper position 58 at the end of a production run (i.e., just prior to the cycle interrupt or point 78 of FIG. 4). Because the nip rolls 16 would be tuline speed, the dancerline speed, the dancer arm 19 would rise from lower position of the production run to position 58 at the end of the production run. At the cycle interrupt, the dancer arm 19 would then fall to lower position 56 and the process would then repeat itself.

The controller 40', via the analog proximity switch 38, is informed of the current position of the dancer arm 19 at a given point on the time line in relation to a given production run. Further, the controller 40' may be programmed with data reflecting where the position of the dancer arm 19 should be at a given points in time in relation to a given production run. For example, the controller 40' may be programmed to know that at two seconds before point 76 on the time line of FIG. 4A, the dancer arm should be at ninety-nine percent of the value of position 58. Should, the dancer arm 19 not be in this position at this point in time, the controller 40' could lower the speed of the nip rolls 16 such that the dancer arm 19 is in position 58 prior to the beginning of the interrupt cycle. Similarly, if at a given point in time, the dancer arm 19 is too high in comparison to the position it should be as inputted into the controller 40', then the speed of the nip rolls may be temporarily increased to lower the dancer arm 19 until the dancer arm 19 is disposed at a location corresponding to the point inputted into the controller 40' for a specified point in time for a given production run. That is the speed of the nip rolls 16 will be corrected such that the dancer arm 19 approximately equals a subsequent preprogrammed position for a subsequent point in time.

As stated earlier, just after the cycle interrupt occurs, the dancer arm 19 should fall to position 56. From this time until the end of the production run, the dancer arm should be in position 58. The controller 40' could, for example, be inputted with points for every bag, cycle, or at regular intervals for a given production run where the dancer arm 19 should be positioned. Further, the position of the dancer arm 19 may, for example, increase linearly until position 58 is reached at the end of the production run. Therefore, each data point for a given bag or cycle of the production run could be compared to the position provided to the controller 40' via the analog proximity sensor 38 corresponding to that given point in time. The speed of the nip rolls 16 may be slightly decreased if the dancer arm 19 is too low or increased if the dancer arm 19 is too high. This comparison continues each bag or cycle during both the production run as well as during the cycle interrupt. If after a given bag or cycle, the dancer arm 19 is still not in the proper position, the process will repeat once again (i.e., the nip roll 19 speed will be increased or decreased) until it coincides with the desired position for that given point in time of the production cycle.

The dancer 18 should be capable of not only storing the film 10 during the cycle interrupt, it should also be capable of having a range in motion of the dancer arm 19 such that the dancer arm can begin at position 56 at the beginning of the production run and end at position 58 at the end of the production run. As a result, additional rolls 17 disposed on the dancer 18 may be added for storing additional film 10 and to help provide the desired range in motion of the dancer arm 19.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. An apparatus for controlling the speed of a web of film for producing bags comprising:

nip rolls for feeding said web;

a dancer having a dancer arm for receiving said web, said dancer arm operating between an upward and downward position, said nip rolls feeding said web to said dancer;

a sensor for sensing a position of said dancer arm;

draw rolls for drawing said web, said web being provided from said dancer to said draw rolls;

means for temporarily stopping the flow of said web at said draw rolls, said means for temporarily stopping defining a cycle interrupt for a duration when said web is temporarily stopped;

means for providing said nip rolls with a fixed speed once said cycle interrupt occurs; and means for providing said nip rolls with a variable speed once said sensor senses that said dancer arm reaches said upward position.

2. The invention of claim 1 wherein said means for providing said nip rolls with a fixed speed comprises a controller, a frequency controller, and a motor.

3. The invention of claim 2 wherein said means for providing said nip rolls with a fixed speed further comprises a potentiometer and a relay.

4. The invention of claim 1 further comprising means for setting said fixed speed approximately equal to an average line speed of said apparatus, said means for setting said fixed speed being operatively connected to said nip rolls.

5. An apparatus for controlling the speed of a web of film for producing bags comprising:

nip rolls for feeding said web;

a dancer having a dancer arm for receiving said web, said dancer arm operating between an upward and downward position, said nip rolls feeding said web to said dancer;

a sensor for sensing a position of said dancer arm;

draw rolls for drawing said web, said web being provided from said dancer to said draw rolls;

means for temporarily stopping the flow of said web at said draw rolls, said means for temporarily stopping defining a cycle interrupt for a duration when said web is temporarily stopped;

a controller for comparing an actual position of said dancer arm for a given point in time in a production run with a preprogrammed position corresponding to said given point in time, during said cycle interrupt; and means for setting a fixed speed in said nip rolls such that a position of said dancer arm approximately equals a subsequent preprogrammed position of said dancer arm for a subsequent point in time.

6. The invention of claim 5 wherein said means for correcting a speed in said nip rolls comprises said controller, a frequency controller, and a motor.

7. The invention of claim 5 wherein said nip rolls operate at approximately an average line speed of said apparatus.

8. The invention of claim 5 wherein said dancer arm is at said upward position at the end of a production run and at said downward position at the end of a cycle interrupt.

9. A method of controlling the speed of a web for producing bags comprising:

in sequence providing said web to nip rolls, to a dancer having a dancer arm, and to draw rolls, said dancer being disposed between said nip rolls and said draw rolls;

temporarily stopping the flow of said web at said draw rolls, said step of temporarily stopping the flow of said web defining a cycle interrupt;

providing said nip rolls with a fixed speed during said cycle interrupt;

sensing a position of said dancer arm during said cycle interrupt, said dancer arm having an upward and downward position; and providing said nip rolls with a variable speed once said dancer arm reaches said upward position.

10. The method of claim 9 further comprising the step of turning off said nip rolls when said dancer arm falls below said downward position.

11. A method of controlling the speed of a web for producing bags comprising:

in sequence providing said web to nip rolls, to a dancer having a dancer arm with an upward and downward position and to draw rolls, said dancer being disposed between said nip rolls and said draw rolls;

temporarily stopping the flow of said web at said draw rolls, said step of temporarily stopping the flow of said web defining a cycle interrupt;

comparing during said cycle interrupt an actual position of said dancer arm for a given point in time in a production run with a preprogrammed position corresponding to said given point in time; and correcting a speed of said nip rolls such that a position of said dancer arm approximately equals a subsequent preprogrammed position of said dancer arm for a subsequent point in time.

12. The method of claim 11 wherein said step of correction corrects said speed in said nip rolls such that said nip rolls operate at approximately an average line speed.

13. The method of claim 12 wherein said dancer arm is at an upward position at the end of said production run and at said downward position at the end of a cycle interrupt.

14. An apparatus for controlling the infeed speed of a web of film, the apparatus for producing and forming a stack of bags, the web drawn by a pair of draw rolls wherein the draw rolls are temporarily stopped during a cycle interrupt during which time the stack is removed, comprising:

nip rolls for feeding the web;

a dancer having a dancer arm for receiving said web, said dancer arm operating between an upward and downward position, said nip rolls feeding said web to said dancer;

a sensor for sensing a position of said dancer arm;

said web being provided from said dancer to the draw rolls;

a control providing said nip rolls with a substantially fixed speed once said cycle interrupt occurs; and said control providing said nip rolls with a variable speed once said sensor senses that said dancer arm reaches said upward position.

15. The apparatus of claim 14 wherein said control trims said substantially fixed speed dependent on a position of said dancer arm.

16. The apparatus of claim 15 wherein said substantially fixed speed is approximately an average line speed of said apparatus.

17. The apparatus of claim 14 wherein said control compares an actual position of said dancer arm for a given point in time during producing and stacking bags with a preprogrammed position corresponding to said given point in time, during said cycle interrupt; and resets said substantially fixed speed of said nip rolls such that a position of said dancer arm approximately equal a subsequent preprogrammed position of said dancer arm for a subsequent point in time.

18. The apparatus of claim 17 wherein said substantially fixed speed is approximately an average line speed of said apparatus.

* * * * *